US006050038A

United States Patent [19]

Fey et al.

[11] Patent Number: 6,050,038

[45] Date of Patent: Apr. 18, 2000

[54] FOUNDATION SYSTEM FOR SUPPORTING A SUPERSTRUCTURE

[76] Inventors: James M. Fey, 1807 Sausal St., Suite A, Oakland, Calif. 94602; Richard R. Erich, P.O. Box 324, Gualala, Calif. 95445

[21] Appl. No.: 09/152,092

[22] Filed: Sep. 11, 1998

[51] Int. Cl.[7] ..... E04C 5/08; E02D 27/42

[52] U.S. Cl. ..... 52/223.7; 52/292; 52/293.2; 52/295; 52/296; 52/604; 52/606

[58] Field of Search ..... 52/223.7, 585.1, 52/604, 606, 292, 293.2, 296, 295

[56] References Cited

U.S. PATENT DOCUMENTS

| | | | |
|---|---|---|---|
| 592,146 | 10/1897 | Kempton . | |
| 657,867 | 9/1900 | Forsythe . | |
| 1,134,897 | 4/1915 | Novess . | |
| 1,271,751 | 7/1918 | Novess . | |
| 2,751,776 | 6/1956 | Streblow et al. | 52/223.7 |
| 2,971,295 | 2/1961 | Reynolds | 52/223.7 |
| 2,982,380 | 5/1961 | Rose . | |
| 3,173,226 | 3/1965 | Solnick | 52/223.7 X |
| 3,292,329 | 12/1966 | Garancsy . | |
| 3,415,475 | 12/1968 | Goodman . | |
| 3,722,159 | 3/1973 | Kessler . | |
| 3,962,088 | 6/1976 | Kuhlenschmidt . | |
| 4,442,149 | 4/1984 | Bennett | 52/223.7 X |
| 4,649,675 | 3/1987 | Moldovan et al. . | |
| 4,714,225 | 12/1987 | Skinner et al. . | |
| 4,723,128 | 2/1988 | Gasque, Jr. . | |
| 4,798,036 | 1/1989 | Pardo . | |
| 4,799,642 | 1/1989 | Wright . | |
| 4,899,500 | 2/1990 | Miller et al. . | |
| 4,912,893 | 4/1990 | Miller et al. . | |
| 4,918,891 | 4/1990 | Gerszewski . | |
| 4,922,264 | 5/1990 | Fitzgerald et al. . | |
| 4,951,433 | 8/1990 | Miller et al. . | |
| 5,142,293 | 8/1992 | Ross . | |
| 5,584,151 | 12/1996 | Abou-Rached . | |
| 5,611,176 | 3/1997 | Juengert et al. . | |
| 5,899,040 | 5/1999 | Cerrato | 52/604 |

FOREIGN PATENT DOCUMENTS

| | | |
|---|---|---|
| 57-140003 | 6/1982 | Japan . |

*Primary Examiner*—Christopher T. Kent
*Attorney, Agent, or Firm*—Theodore J. Bielen, Jr.

[57] ABSTRACT

A foundation structure for supporting a superstructure utilizing a first block and a second block, with a third block disposed between the first and second blocks. Each block includes a top, bottom, and sidewall portion, as well as an interlocking mechanism. At least one chase extends through each of the blocks. The chases are alignable with one another to permit use of an elongated member such as a rod or wire rope which passes through all of the blocks when they are placed in side-by-side orientation. The elongated members are tensioned, causing compression of the blocks into a foundation unit with a contiguous top surface. A superstructure is supported to the top surface of the foundation unit.

13 Claims, 6 Drawing Sheets

FOUNDATION SYSTEM FOR SUPPORTING A SUPERSTRUCTURE

BACKGROUND OF THE INVENTION

The present invention relates to a novel and useful foundation system for securing a superstructure such as a tower monopole or antenna.

Towers and antennas are used throughout the world for supporting power transmission wires, signs, and electronic mechanisms, such as communications devices, which either transmit or receive communication signals. To support such superstructures, anchors or foundations must be provided to ensure proper operation of the same.

In the past, foundations have been cast and poured in the usual manner requiring the transportation of building materials to a site, provision of foundation erecting equipment, and the necessary manpower to achieve this task. Unfortunately, superstructures, such as antennas and towers, are often required in remote areas. Providing a proper foundation for such superstructures has proved expensive and difficult.

Many prior, foundation structures for superstructures have been proposed. For example, U.S. Pat. Nos. 4,723,128, 4,799,642, 4,899,500, 4,912,893, 4,951,433, and Japanese Patent 57-14003 depict mounting structures using beams and struts constructed of steel which are fastened to a surface.

U.S. Pat. Nos. 1,134,897, 1,271,751, 3,292,329, 4,649,675, 4,714,225, 4,918,891, and 5,612,176 depict foundation structures for superstructures, such as antennas, which use poured in monolithic concrete bases that are either surface mounted or are imbedded in a surface.

U.S. Pat. No. 5,584,151 describes a pre-fabricated building panel which employs frame members which are connected together to form a building.

U.S. Pat. Nos. 3,415,475 and 5,142,293 shows weighted bases for superstructures that are composed of multiple members.

U.S. Pat. Nos. 2,982,380, 3,722,159, and 4,798,036 illustrate pre-fabricated concrete structures which use interlocking blocks to form a foundation or footing.

U.S. Pat. No. 592,146 reveals a fence post structure using a series of stacked blocks which are placed in a ground surface along with rods that support superstructures such as a fence post.

U.S. Pat. Nos. 657,867 and 3,962,088 teach block assemblies which are stacked together and include tension rods to hold the blocks together.

U.S. Pat. No. 4,922,264 depicts an antenna mounting apparatus that utilizes a quartet of feet formed of blocks that are independently tied together. The antenna structure in the central portion of the mounting foundation utilizes metallic frame which is tied to the foundation feet by struts.

Unfortunately, the prior art systems for supporting superstructures do not use pre-fabricated monolithic foundation structures which are capable of supporting superstructures such as antennas adequately in various environmental conditions.

SUMMARY OF THE INVENTION

In accordance with the present invention a novel and useful foundation system for securing a superstructure is herein provided.

The system of the present invention utilizes a plurality of blocks, each including a top, bottom, and sidewall portion.

Each of the blocks is also provided with at least a first chase extending from one place at the sidewall portion to another place at the sidewall portion of the block. In its essential condition, the foundation system of the present invention would utilize first, second, and third blocks which are disposed adjacent one another. In this condition, the chases of the first, second, and third blocks are alignable. Means is provided for compressing the first, second, and third blocks into a foundation unit with a top surface that is contiguous. The top surface is formed by the tops of the first, second, and third blocks. The compressing means may take the form of an elongated member which passes through the aligned chases of the first, second, and third blocks. Means is also included for tensioning the elongated members in this configuration to compress the blocks into a monolithic unit.

In certain cases, other blocks may be employed along side the aligned first, second, and third blocks to form larger foundation structures. In this arrangement, the first, second, and third blocks may include second chases which are angularly disposed relative to the first chases therethrough. Means is provided for compressing the lateral blocks to the first, second, and third blocks, in the same manner through the angularly disposed chases which are also alignable. Moreover, additional blocks may be used as needed to form larger and larger foundation structures in all directions, as desired.

Support means is also provided in the present invention for holding a superstructure at the top surface of the foundation unit formed by the multiplicity of compressed blocks. The support means for holding the superstructure may be placed in the foundation structure without interfering with the means for compressing the multiplicity of blocks together.

In addition, the system of the present invention utilizes interlocking means for linking the multiplicity of blocks together to form a common and contiguous top surface. Such interlocking means may take the form of protrusions and indents, generally cast into the block structures.

The blocks used in the system of the present invention may be filled with liquid or solid material (precasting) to provide the necessary mass to support the superstructure being supported at the top surface of the foundation unit formed by such blocks. For example, concrete would be a particularly useful material, in this regard.

It may be apparent that a novel and useful foundation system for securing a superstructure has been described.

It is therefore an object of the present invention to provide a foundation system for securing a superstructure which is relatively cheap to manufacture and assemble.

Another object of the present invention is to provide a foundation system for securing a superstructure which is easily manufactured under quality control conditions.

A further object of the present invention is to provide a foundation system for securing a superstructure which is not susceptible to unruly weather conditions during its manufacture.

Yet another object of the present invention is to provide a foundation system for securing a superstructure which is easily transported and assembled to particular sites, such as remote sites.

A further object of the present invention is to provide a foundation system for securing a superstructure which is versatile in size and weight to provide adequate anchoring of superstructures of various sizes.

Another object of the present invention is to provide a foundation system for securing a superstructure which requires minimal removal of material from a site and results in minimal damage to the same.

Another object of the present invention is to provide a foundation system for securing a superstructure which does not require the formation of piers.

The invention posses other objects and advantages especially as concerns particular characteristics and features, thereof, which will become apparent as the specification continues.

For a better understanding of the invention reference is made to the following detailed description of the preferred embodiments thereof which should be taken in conjunction with the prior described drawings.

DETAILED DESCRIPTION OF THE PREFERRED EMBODIMENTS

Various aspects of the present invention will evolve from the following detailed description of the preferred embodiments thereof which should be taken in conjunction with the previously detailed drawings.

Figure 1:
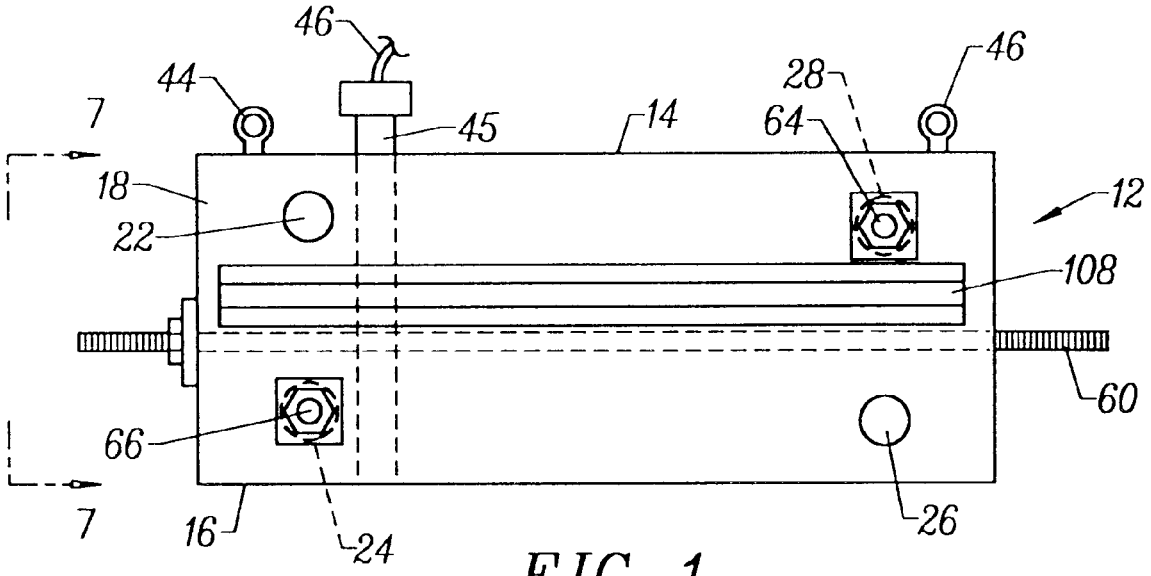
FIG. 1 is a side elevation view of a typical block used in the foundation system of the present invention.
Figure 2:
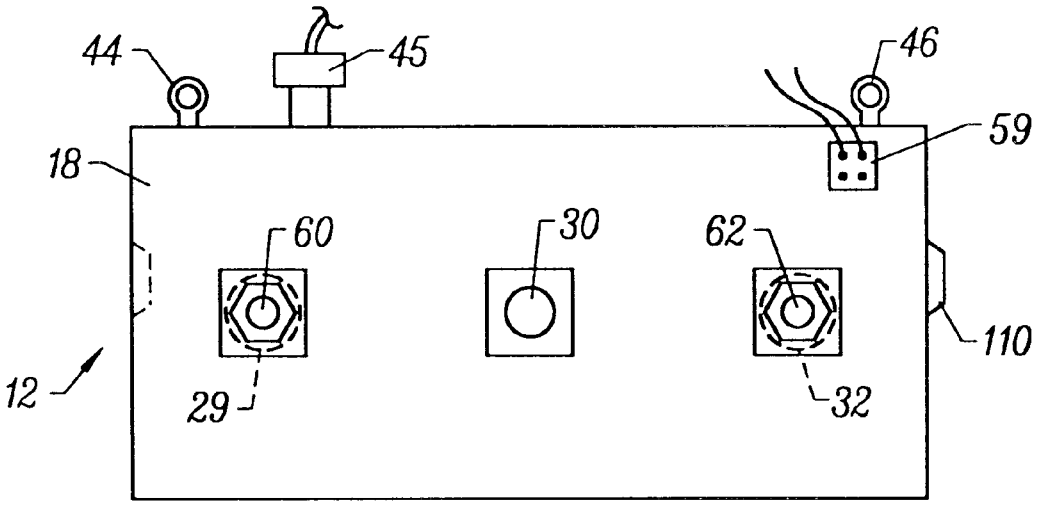
FIG. 2 is a right end view of a typical block using the foundation system of the present invention.

The invention as a whole is depicted in the drawings by reference character 10. System 10 includes as one of its elements a block 12. Block 12 may be of a rectangular solid configuration, as shown in FIGS. 1 and 2, or may take other configurations to permit the same to lie in side-by-side configuration, which will be explained in greater detail as the specification continues.

Block 12 is formed with a top 14, bottom 16, and sidewall portion 18, which extends completely around block 12. Bottom 16 is intended to sit on a ground surface 20, FIG. 4. Block 12 is typical of the multiplicity or plurality of blocks used in the system 10 of the present invention. As shown in FIGS. 1 and 2, block 12 includes chases 22, 24, 26, and 28 which pass through sidewall portion 18 at two distinct places. In addition, FIG. 2, chases 29, 30, and 32 extend through sidewall portion 18 of block 12 in another direction, generally at right angles to chases 22, 24, 26, and 28. Each of the chases, above-identified, may include a sleeve formed of pipe-like material such as polyvinyl chloride, polypropylene, metal, and the like.

Figure 3:
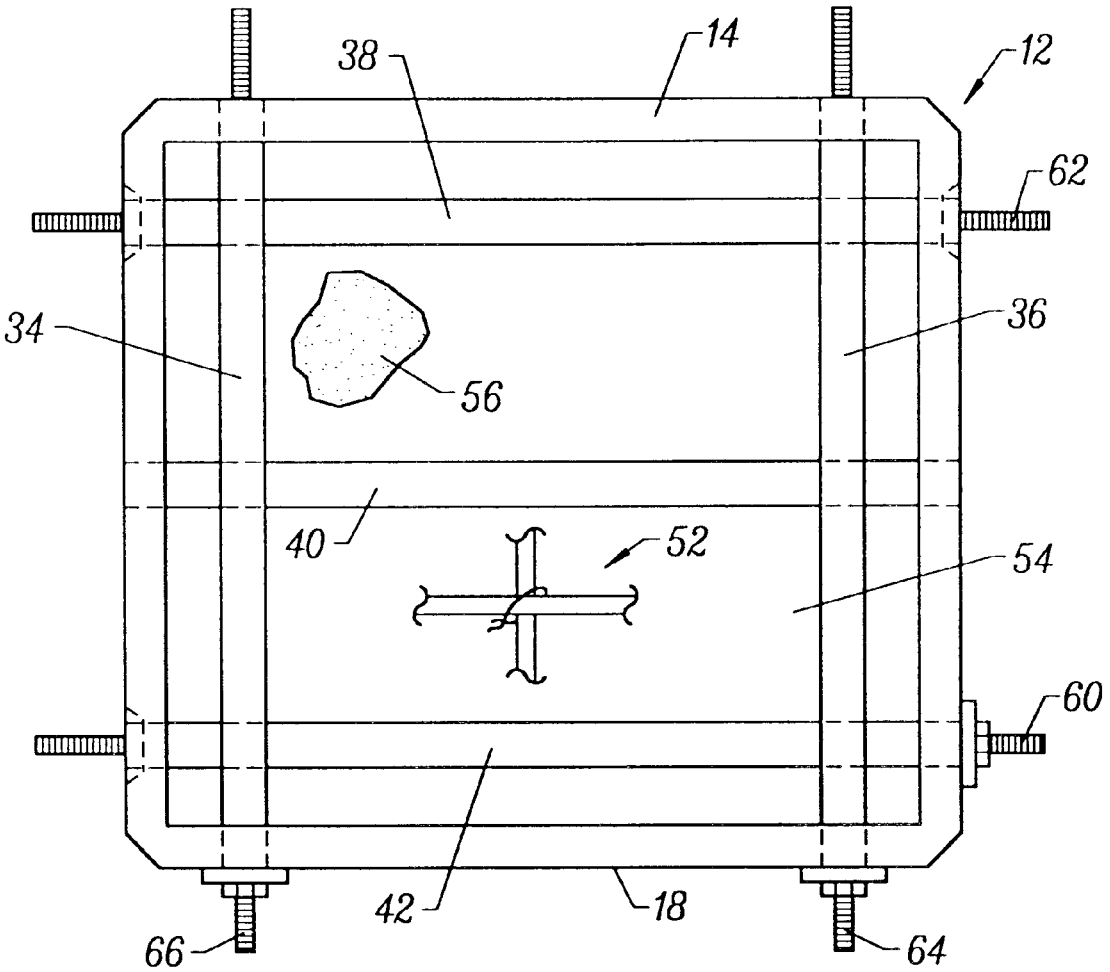
FIG. 3 is a top plan view of the block depicted in FIGS. 1 and 2 prior to filling with bulk material.

With reference to FIG. 3, block 12 is illustrated in its open condition. Sleeves 34 and 36 are associated with chases 22 and 28, respectively. Also, sleeves 38, 40, and 42 are associated with chases 28, 30, and 32, respectively. Block 12 also is formed with lifting rings 44 and 46 to aid in the movement of the same, since block 12 is intended to be pre-fabricated under controlled conditions prior to transportation for use in a particular environment. Conduit 45 permits the use of cabling 46 or other wire extending from the bottom 16 of block 12 to top 14, thereof, which will be used with the eventual superstructure antenna. Reinforcing bars 52 are also employed within cavity 54 of block 12. Concrete, represented by concrete portion 56, completely fills cavity 54 in the construction of block 12. Electrical cabling blocks 59 are also utilized within block 12 and are optionally tied to reinforcing bars 52 within cavity 54.

Figure 4:
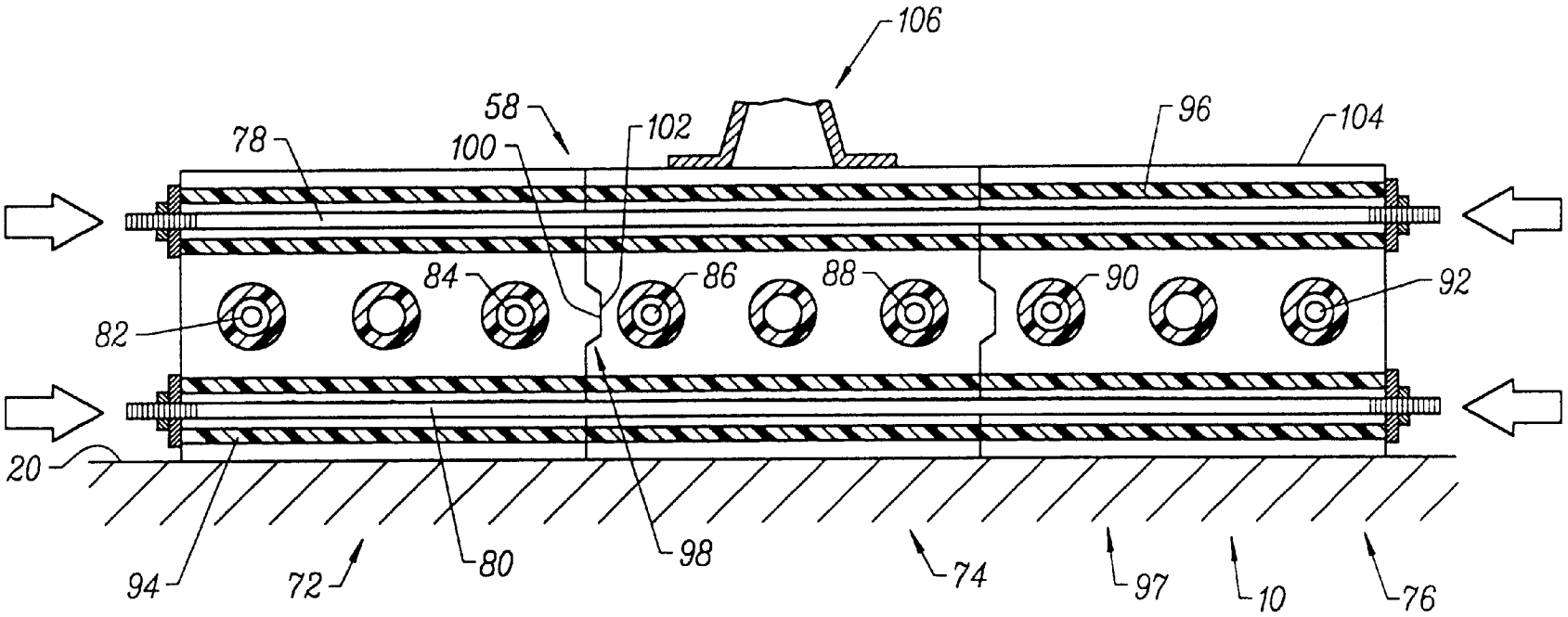
FIG. 4 is a sectional view showing a trio of blocks tensioned together to form a foundation unit.

Means 58 is also shown in the present invention for compressing a plurality of blocks, similar to block 12, together, FIG. 4. Returning again to FIGS. 1–3 it may be observed that elongated members, such as threaded rods, wire ropes and the like, shown as threaded rods 60, 62, 64, and 66, may be employed as a portion of means 58. Rods 60, 62, 64, and 66 pass through chases 29, 32, 28, and 24, respectively. It should be noted that elongated threaded rods 64 and 66 are angularly disposed relative to rods 60 and 62, and the chases associated with such rods.

Figure 7:
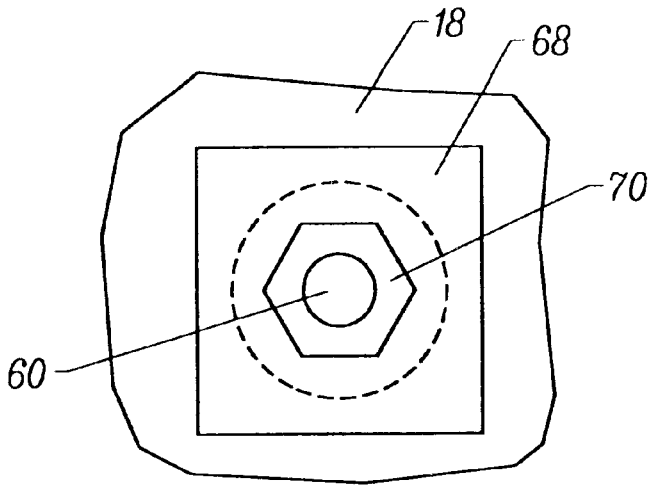
FIG. 7 is an enlarged sectional view taken along line 7—7 of FIG. 1.

It should be seen that chases 22, 26, and 30 are not being used in FIGS. 1–4, but may be employed, if desired, to accommodate other threaded rods used as a part of compressing means 58. In any case, each threaded rod shown in the drawings has an associated plate and nut which may be employed to tension rods 60, 62, 64, and 66, thus, compressing a multiplicity of blocks together. FIG. 7 depicts a detail of a typical elongated rod 60 in which plate 68 is pressed against sidewall portion 18 of block 12. Plate 68 may be precast into block 12. Nut 70 is internally threaded to threadingly engage threaded rod or elongated member 60. It should be realized that, hydraulic means may be used to tension elongated members through the chases noted above.

Turning to FIG. 4, it may be observed that blocks 72, 74, and 76 are placed against, or nested, to one another as depicted. Compressing means 58 is employed with respect to elongated members or threaded rods 78, 80, 82, 84, 86, 88, 90, 92, and others not shown. In essence, such threaded rods extend completely through blocks 72, 74, and 76. For example, chase 96 accommodates threaded rod 78 while chase 94 accommodates threaded rod 80, in this manner. The tightening of the nuts, associated with such threaded rods is depicted in FIG. 4, tensions such rods and compresses blocks 72, 74, and 76 together, forming a foundation unit 97.

In addition, interlocking means 98 is shown in FIGS. 1–4. Interlocking means 98 may take the form of a multiplicity of protrusions and indents on adjacent blocks that mate with one another. For example, block 72 includes a protrusion 100 which mates with an indent 102 on block 74. Interlocking means 98 provides a contiguous upper surface 104 on foundation unit 97, which serves as an ideal platform for superstructure 106. Returning again to block 12, FIGS. 1 and 2, it may be observed that an indent 108 and a protrusion 110 is shown thereat and constitutes part of interlocking means 98.

Figure 5:
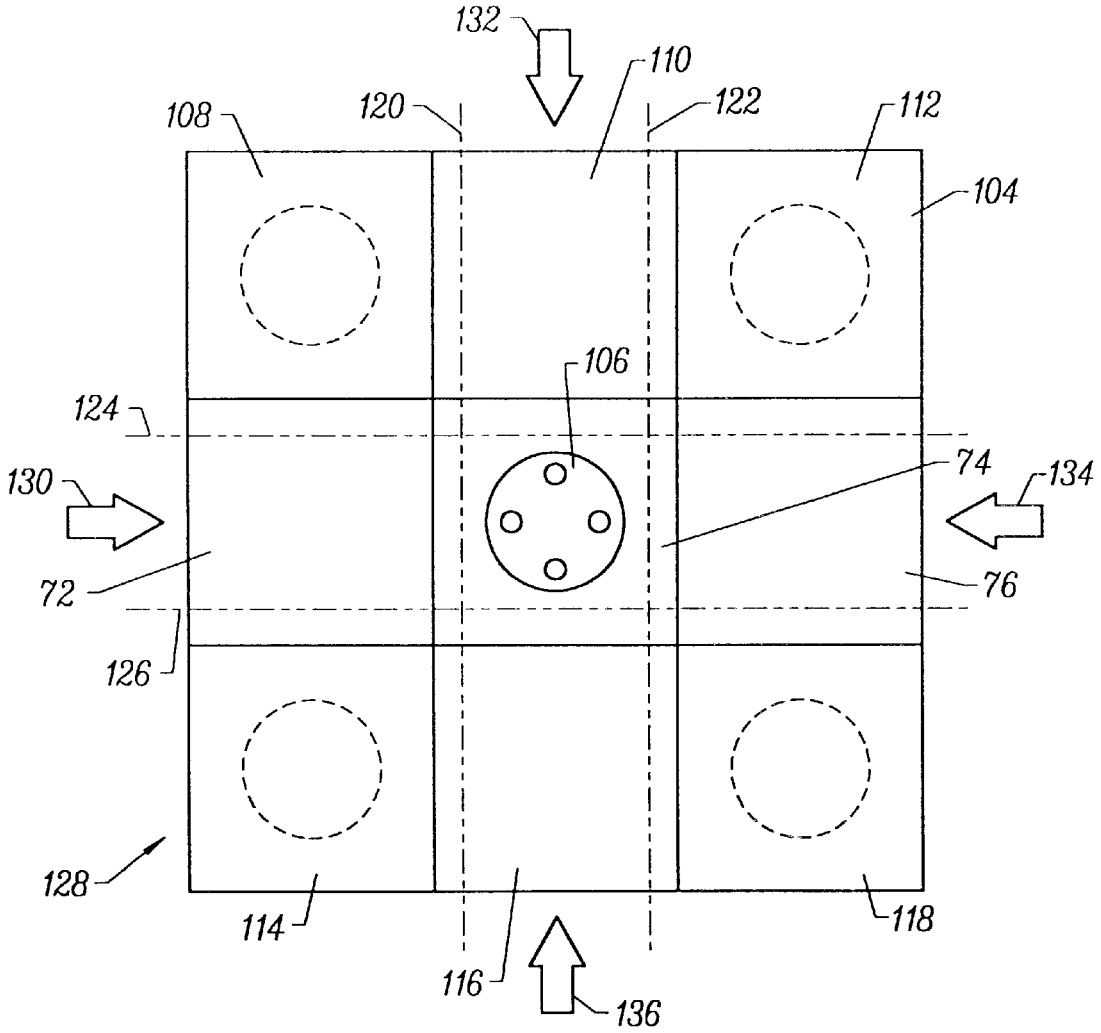
FIG. 5 is a foundation structure utilizing nine blocks, each constructed similarly to the block depicted in FIGS. 1 and 2.

Turning to FIG. 5, it may be apparent that additional blocks 108, 110, 112, 114, 116, and 118 are depicted relative to block 72, 74, and 76. Compressing means 58 is partially and schematically depicted by dashed lines 120, 122, 124, and 126. It should be understood, that elongated members or threaded rods pass through each of the blocks depicted in FIG. 6 in at least two directions forming a monolithic unit 128, according to compressing means 58 heretofore described. Force arrows 130, 132, 134, and 136 generally depict the compression of the blocks depicted in FIG. 5. together into monolithic unit 128. Superstructure 106 is shown as being placed in central block 74. Corner blocks 108, 112, 114, or 118 may also serve as support for superstructure 106 on surface 104. In fact, any of the blocks depicted in FIG. 5 may support superstructure 106.

Figure 8:
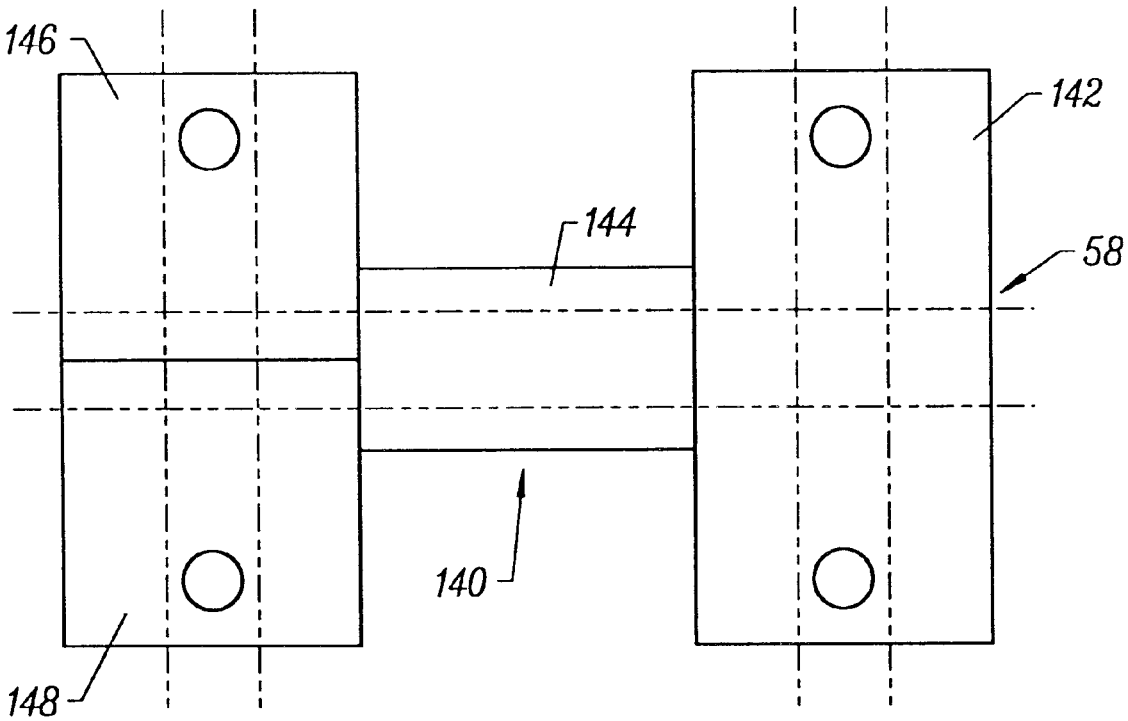
FIG. 8 is a top plan view of yet another arrangement of blocks to support a superstructure, with the tensioning rods depicted schematically.

FIG. 8 shows another configuration of blocks forming a monolithic structure 140 according to the principles of the present invention. For example, blocks 142, 144, 146, and 148 may be employed in this regard. The circles shown in FIG. 8 may serve as a place for a foot or leg of a lattice type tower. Adjacent blocks 146 and 148 may be unitary and of a similar construction to block 142. Again, the tensioning rods of compressing means 58 is shown schematically by dashed lines.

Figure 6:
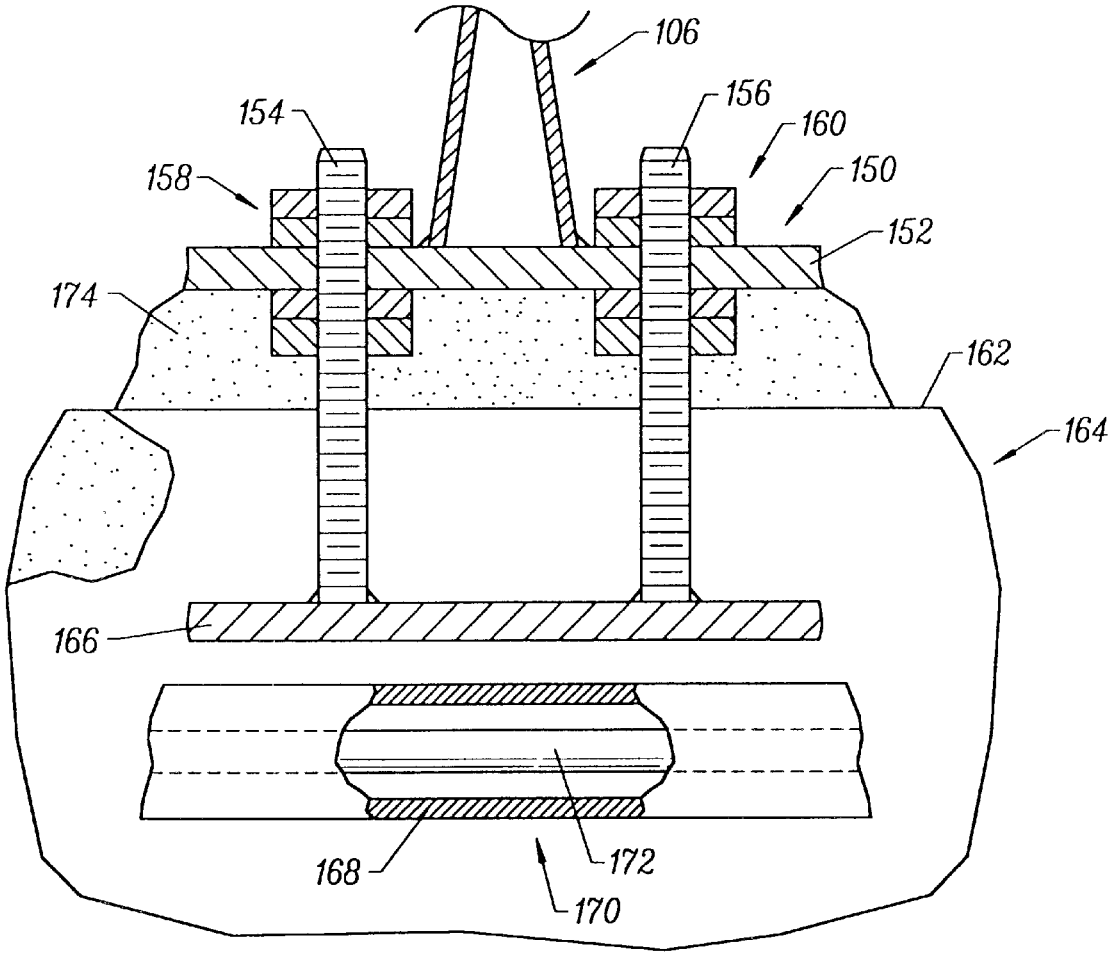
FIG. 6 is a sectional view showing a typical superstructure support which may be employed in the block depicted in FIGS. 1 and 2.

Turning to FIG. 6, a typical mounting structure 150 is illustrated with respect to superstructure 106. Superstructure 106 is welded to a plate 152 which is placed on threaded rods 154 and 156. Plurality of nuts 158 and 160 adjust the height of plate 152 and, thus, superstructure 106 above top surface 162 of a monolithic unit formed by a plurality of blocks such as block 164. Plate 166 is imbedded in the concrete portion of block 164 and is clear of sleeve 168 of chase 170, as well as tensioning rod 172 thereof. Mortar or concrete mass 174 may be used to fill the space beneath plate 152. Of course, other mounting structures may be used to hold superstructure 106, such as precast pipes or tubes.

In operation, the user transports blocks, such as block 12, to a particular site for the support of superstructure 106. Superstructure 106 may take the form of an antenna, or similar item. Plurality of blocks are then assembled together as shown in FIGS. 4, 5, or 8, or in any other particular format desired. The number of blocks would depend on the mass and moment requirements associated with superstructure 106. The superstructure 106 anchor may be placed to any one of the blocks shown in FIGS. 4, 5, and 8 by suitable means such as mounting structure 150 depicted in FIG. 6. It should be noted that other methods of supporting superstructure 106 may be employed. Compression means 58 is then used to compress the plurality of blocks depicted in FIGS. 4, 5, or 8 together with the use of elongated tensioning rods and the chases formed in the plurality of blocks. Such tensioning takes place in multiple directions to form a monolithic unit in any case, typically such as the monolithic unit 128 depicted in FIG. 5. System 10 then permits the placement of superstructure 106 to mounting structure 150. System 10 is usable in various terrains and environments since each block used in any particular arrangement of the present invention is pre-fabricated under controlled conditions.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A foundation system for securing a superstructure comprising;

a. a first block including a top, bottom, and a sidewall portion said first block further including at least a first chase extending from one place at said sidewall portion through said first block to another place at said sidewall portion;

b. a second block including a top, a bottom, and a sidewall portion said second block further including at least a first chase, extending from one place at said sidewall portion, through said second block to another place at said sidewall portion;

c. a third block disposed between said first and second blocks, said third block including a top, a bottom, and a sidewall portion, said third block further including at least a first chase extending from one place at said sidewall portion, through said third block to another place in said sidewall portion said at least first chases of said first, second, and third blocks being alignable;

d. means for compressing said first, second, and third blocks into a foundation unit defined between said sidewall portion of said first block and said sidewall portion of said second block with a top surface thereat, said compressing means comprising an elongated member passing through said aligned chases of said first, second, and third blocks, and means for tensioning said elongated member relative to said first and second block sidewall portions; and e. support means intended for holding a superstructure at said top surface of said foundation unit, said support means being embedded selectively in said first, second, and third blocks formed into said foundation unit by said means for compressing said first, second, and third blocks.

2. The system of claim 1 in which said elongated member extending through said first, second, and third block is a threaded member and said means for tensioning said threaded member includes at least one threaded nut threadingly engaging said threaded rod.

3. The system of claim 1 in which said support means is adapted to hold the superstructure to said foundation unit at said third block.

4. The system of claim 1 in which said support means is adapted to hold the superstructure to said foundation unit at said first and second blocks.

5. The system of claim 1 which further comprises means for interlocking said first, second, and third blocks to form said top surface of said foundation unit in which said top surfaces of said first, second, and third blocks are essentially contiguous.

6. The system of claim 1 in which at least one of said at least first chases of said first, second, and third blocks include a preformed sleeve.

7. The system of claim 5 in which said interlocking means comprises at least one protrusion on the sidewall portion of said first block and an indent on the sidewall portion of said second block, said protrusion of said first block formed to mate with the indent of said second block.

8. The system of claim 1 which additionally comprises a fourth block, said fourth block including a top, a bottom, and a sidewall portion, said fourth block further including a chase extending from one place at said sidewall portion, through said fourth block to another place at said sidewall portion, selectively said first, second and third block including a second chase extending from one place at said sidewall portion through said first, second, and third block, to another place at said sidewall portion, said second chase being alienable with said chase through said fourth block, and means for compressing said fourth block selectively to said first, second, and third blocks.

9. The system of claim 8 in which said elongated member extending through said first, second, and third block is a threaded member and said means for tensioning said threaded member includes at least one threaded nut threadingly engaging said threaded rod.

10. The system of claim 9 in which said support means is adapted to hold the superstructure to said foundation unit at said third block.

11. The system of claim 9 in which said support means is adapted to hold the superstructure to said foundation unit at said first and second blocks.

12. The system of claim 8 which further comprises means for interlocking said first, second, third, and fourth blocks to form another foundation unit having a common top surface.

13. The system of claim 12 in which said top surface of said another foundation unit comprises said top surfaces of said first, second, third, and fourth blocks being contiguous.

* * * * *